US005360691A

United States Patent [19]

Koizumi et al.

[11] Patent Number: 5,360,691

[45] Date of Patent: Nov. 1, 1994

[54] CARRIER FOR DEVELOPING ELECTROSTATIC LATENT IMAGES, DEVELOPER, AND ELECTROPHOTOGRAPHIC DEVELOPING PROCESS

[75] Inventors: Katsuo Koizumi, Kanagawa; Shigenori Otsuka; Syuuichi Maeda, both of Saitama; Hiromi Horiuchi, Tokyo; Hirofumi Oda; Toshiyuki Sueyoshi, both of Kanagawa, all of Japan

[73] Assignee: Mitsubishi Kasei Corporation, Tokyo, Japan

[21] Appl. No.: 879,292

[22] Filed: May 7, 1992

[30] Foreign Application Priority Data

May 8, 1991 [JP] Japan ..... 3-102833

[51] Int. Cl.[5] ..... G03G 9/08

[52] U.S. Cl. ..... 430/108; 430/106.6; 430/110; 430/111; 430/124; 430/125; 430/126; 430/904

[58] Field of Search ..... 430/106.6, 108, 110, 430/111, 124, 125, 126, 904

[56] References Cited

U.S. PATENT DOCUMENTS

| | | | |
|---|---|---|---|
| 3,795,617 | 3/1974 | McCabe | 430/106.6 |
| 3,795,618 | 3/1974 | Kasper | 430/108 |
| 3,898,170 | 8/1975 | Kasper | 430/108 |
| 4,338,390 | 7/1982 | Lu | 430/106 |
| 4,614,699 | 9/1986 | Kitatani et al. | 430/115 |
| 4,902,597 | 2/1990 | Takeda et al. | 430/106.6 |
| 4,929,528 | 5/1990 | Shinoki et al. | 430/108 |
| 4,933,253 | 6/1990 | Aoki et al. | 430/110 |
| 5,059,504 | 10/1991 | Shinoki et al. | 430/108 |
| 5,110,703 | 5/1992 | Nagatsuka et al. | 430/108 |

FOREIGN PATENT DOCUMENTS 0363900 4/1990 European Pat. Off. .

OTHER PUBLICATIONS

Japanese Patents Abstracts, Week 9043, Derwent Publications Ltd., London, GB; AN 90-323341 (43) and JP-A-2 233 956 (Fuji Xerox K.K.) Sep. 6, 1990.

Patent Abstracts of Japan, vol. 3, No. 102 (E-133) Aug. 29, 1979 (Ricoh Co., Ltd.) Jun. 23, 1979, and JP-A-54 079 040.

Patent Abstracts of Japan, vol. 10., No. 316 (P-510) Oct. 28, 1986 (Konishiroku Photo Ind., Co., Ltd.) Jun. 14, 1986, and JP-A-61 126 564.

Japanese Patents Gazette, Week 8404, Derwent Publ. Ltd., London, GB; AN 84-020587 & JP-A-58 211 167 (Konishiroku Photo, K.K.) Dec. 8, 1983.

*Primary Examiner*—John Kight, III
*Assistant Examiner*—Shelley A. Dodson
*Attorney, Agent, or Firm*—Sughrue, Mion, Zinn, Macpeak & Seas

[57] ABSTRACT

A carrier for developing electrostatic latent images is disclosed, which comprises a core material at least a part of which is coated with a resin containing a copolymer comprised of vinylidene chloride and at least one monomer having an unsaturated double bond and being copolymerizable with vinylidene chloride, wherein the copolymer is comprised of (a) from 70 to 30 mol % of vinylidene chloride, (b) from 20 to 60 mol % of acrylonitrile and/or an acrylonitrile derivative, and (c) from 0 to 40 mol % of a monomer having an unsaturated double bond and being copolymerizable with components (a) and (b). An electrophotographic developer containing the carrier and an electrophotographic developing process using the developer are also disclosed.

27 Claims, No Drawings

CARRIER FOR DEVELOPING ELECTROSTATIC LATENT IMAGES, DEVELOPER, AND ELECTROPHOTOGRAPHIC DEVELOPING PROCESS

FIELD OF THE INVENTION

The present invention relates to a carrier for developing electrostatic latent images being used for an electrophotographic copying apparatus, a developer using the carrier, and an electrophotographic developing process.

BACKGROUND OF THE INVENTION

Since an electrophotographic technique has an immediacy and can provide images having a high image quality, the technique has recently been widely used in not only the field of copying apparatus but also the field of various printers. Also, as to a latent image holding member (photoreceptor) which is the central part of the electrophotographic technique, inorganic photoconductive materials such as selenium, an arsenic-selenium alloy, cadmium sulfide, zinc oxide, amorphous silicon, etc., have hitherto been used as the photoconductive material but recently organic photoconductive materials which causes no pollution problem and is advantageous in the filming property and the producibility have been variously developed. In these organic latent image holding members, a so-called laminate type organic latent image holding member composed of the laminated layers of a charge generating layer and a charge transport layer has been practically used in many fields owing to the high sensitivity and the long life.

On the other hand, in a two-component developer composed of a positively chargeable toner and a negatively chargeable resin-coated carrier in the electrophotography, fluorine series resins such as a copolymer of vinylidene fluoride and tetrafluoroethylene, a fluoroalkyl methacrylate copolymer, etc., and silicone series resins have been proposed as a resin for coating the carrier in JP-A-61-217068, JP-A-62-24268, and JP-A2-96770 (corr. EP 362650A) (the term "JP-A" as used herein means an "unexamined published Japanese patent application").

Also, JP-A-53-92134 discloses that the surface of a carrier is coated with a chlorinated or brominated vinyl series copolymer and as a monomer for the copolymers, vinylidene chloride is exemplified. However, the technique practically disclosed and used therein is a cascade development only using a carrier coated with a copolymer of vinyl chloride.

These coated carriers have both merits and demerits. For example, it is known that the carriers coated with a fluorine series resin has a good chargeability but some of these carriers have demerits in the charging stability, the adhesion between the coated resin and the carrier core, etc., and also the carriers coated with a silicone series resin also have the foregoing merit but have a demerit that the adhesion between the coated resin and the core is poor and the coated resin is gradually peeled off. Accordingly, these carriers have the demerit of lacking in durability such that the copied images successively formed become unstable and the formation of a background stain (hereinafter, referred to as fog) is gradually increased with repeating the copying procedure using the carrier.

A cascade process was hitherto used for development, but since such the cascade process had the problems that the apparatus using the cascade process was reluctant to be small-sized and the image quality was easily deteriorated due to scattering of toner particles and a so-called edge effect, i.e., a phenomenon that the density of both edges of a fine line formed was increased, a magnetic brush developing process has recently been used.

In the magnetic brush development process, since the surface hardness of an organic latent image holding member is less than that of an inorganic latent image holding member, when, for example, a silicone series resin is used as a coating resin of a carrier at the magnetic brush development, image defects by the abrasion of the magnetic brush is increased with the increase of number of copies. In particular, in half tone images, stripe-like defects are greatly increased. Thus, the use of conventional organic latent image holding members has the demerit of lacking in the durability thereof.

SUMMARY OF THE INVENTION

As the result of various investigations for solving the foregoing problems in the conventional techniques, the inventors have discovered that a carrier coated with a copolymer formed by the copolymerization of vinylidene chloride and other monomer greatly reduce the foregoing defects, shows excellent characteristics, and by using the coated carrier, clear images having very little fog and image defects are obtained, and further the coated carrier has a faculty of increasing the transfer efficiency of toner images. The present invention has been attained based on the above discovery.

That is, according to an embodiment of the present invention invention, there is provided a carrier for developing electrostatic latent images, comprising a core material at least a part of which is coated with a resin containing a copolymer comprised of vinylidene chloride and at least one monomer having an unsaturated double bond and being copolymerizable with said vinylidene chloride, wherein said copolymer is a copolymer comprising (a) from 70 to 30 mol % of vinylidene chloride, (b) from 20 to 60 mol % of acrylonitrile and/or an acrylonitrile derivative, and (c) from 0 to 40 mol % of a monomer having an unsaturated double bond and being copolymerizable with these components (a) and (b).

Also, according to another embodiment of the present invention, there is provided a developer for an electrostatic latent image, comprising a carrier and a positively chargeable toner, said carrier comprising a core material at least a part of which is coated with a resin containing a copolymer comprised of vinylidene chloride and at least one monomer having an unsaturated double bond and being copolymerizable with said vinylidene chloride.

Furthermore, according to still another embodiment of the present invention, there is further provided an electrophotographic developing process using an organic photoconductor as an electrostatic latent image holding member and using an electrostatic latent image developer containing a carrier and a toner, which comprises developing an electrostatic latent image by a magnetic brush developing process using a carrier comprising a core material at least a part of which is coated with a resin containing a copolymer comprised of vinylidene chloride and at least one monomer having an unsaturated double bond and being copolymerizable with said vinylidene chloride.

DETAILED DESCRIPTION OF THE INVENTION

The carrier of the present invention is a carrier at least a part of which is coated with a resin containing a copolymer of vinylidene chloride and at least one monomer having an unsaturated double bond and being copolymerizable with said vinylidene chloride, and the copolymer is preferably a binary copolymer comprised of (a) vinylidene chloride and (b) acrylonitrile and/or an acrylonitrile derivative, or a multi-component copolymer comprised of (a) vinylidene chloride, (b) acrylonitrile and/or an acrylonitrile derivative, and (c) a monomer having an unsaturated double bond and being copolymerizable with components (a) and (b).

In this invention, a typical example of the acrylonitrile derivative is methacrylonitrile, that is, as (b) acrylonitrile and/or an acrylonitrile derivative, there are acrylonitrile alone, methacrylonitrile alone, and a mixture of acrylonitrile and methacrylonitrile at an optional ratio.

Also, in the present invention, as the monomer having an unsaturated double bond and being copolymerizable with vinylidene chloride, there are styrenes such as styrene, α-methylstyrene, chloromethylstyrene, etc.; α-substituted or unsubstituted alkyl acrylates or methacrylates (collectively referred to as "(meth)acrylates") such as methyl acrylate, ethyl acrylate, propyl acrylate, butyl acrylate, amyl acrylate, hexyl acrylate, octyl acrylate, 2-choroethyl acrylate, methyl α-fluoroacrylate, ethyl α-fluoroacrylate, methyl α-chloroacrylate, methyl methacrylate, ethyl methacrylate, propy methacrylate, butyl methacrylate, amyl methacrylate, hexyl methacrylate, octyl methacrylate, 2-chloroethyl methacrylate, etc.; vinyl ethers such as ethyl vinyl ether, 2-chloroethyl vinyl ether, propyl vinyl ether, butyl vinyl ether, octyl vinyl ether, cyclohexyl vinyl ether, phenyl vinyl ether, etc.; vinyl esters such as vinyl acetate, vinylchloro acetate, vinyl butyrate, vinyl pivalate, vinyl benzoate, etc.; vinyl ketones such as methyl vinyl ketone, ethyl vinyl ketone, propyl vinyl ketone, butyl vinyl ketone, phenyl vinyl ketone, etc.; olefins such as ethylene, propylene, isobutene, butadiene, isoprene, etc.; and nitrogen-containing compounds such as N-vinylpyrrolidone, N-vinylcarbazole, 4-vinylpyridine, etc. These monomers can be used singly or as a mixture thereof.

In the present invention, the ratio of (a) vinylidene chloride, (b) acrylonitrile and/or an acrylonitrile derivative, and (c) the monomer having an unsaturated double bond and being polymerizable with those components is preferably from 70 to 30 mol % for component (a), from 20 to 60 mol % for component (b), and from 0 to 40 mol % for component (c), and more preferably from 60 to 30 mol % for component (a), from 20 to 50 mol % for component (b), and from 0 to 30 mol % for component (c) in the point of sufficiently obtaining the effect of the present invention. Also, in the case of the binary copolymer, the preferred copolymerization ratio is from 60 to 40 mol % for component (a) and from 40 to 60 mol % for component (b).

If the content of vinylidene chloride is too large, the properties of the copolymer become similar to those of a vinylidene homopolymer, which is thermally unstable and is hard to use since it is not dissolved in the majority of solvents, and even if such a copolymer is used, the fluidity of the carrier coated with the copolymer becomes inferior resulting in bad influence on the copied images. Also, if the content of vinylidene chloride is too small, the charging property for toner particles become insufficient, giving bad influence on the copied images. Furthermore, if the content of the monomer (c) is too large, the charge stability of the carrier becomes inferior, also giving bad influence on the copied images.

The copolymer of the present invention preferably has a glass transition temperature of from 20° to 90° C.

Commercially available resins which can be used for the binary or multi-component copolymer of this invention include Saran Resins F-239, F-278, and F-310 (trade names, made by Dow Chemical Co.); Saran Resins F-216, R-200, R-202, and R-241R (trade names, made by Asahi Kasei Kogyo K.K.); Kureharon Latexes DO-818, DO-822, and DO -873S (trade names, made by Kureha Chemical Industry Co., Ltd.); Diofan A-690 (trade name, made by Mitsubishi Yuka Bardishe K.K.), etc.

The weight average molecular weight of the copolymer for use in this invention is usually from about $6\times10^4$ to $60\times10^4$, and preferably from about $20\times10^4$ to $40\times10^4$ when measured by gel permeation chromatography (calculated as polystyrene).

If the weight average molecular weight of the copolymer is too low, the fluidity of the coated carrier is undesirably reduced. Also, if it is too high, there is no problem in the performance but, since the solubility of the copolymer in a solvent is lowered, the coating treatment with the copolymer is undesirably complicated.

The copolymer of this invention can be produced by a radical polymerization, a bulk polymerization, a suspension polymerization, an emulsion polymerization, a solution polymerization, etc.

As a coating material for the carrier core material, the foregoing copolymer may be used in a form of a composition blended with other resins or materials. Practical examples of such resins or materials to be used with the copolymer include a fluorine resin (e.g., polyvinylidene fluoride and a vinylidene fluoride-tetrafluoroethylene copolymer), a silicon resin, an acrylic resin, a polyester resin, a polycarbonate resin, an epoxy resin, a phenoxy resin, a polyamide resin, an olyimide resin, a urea resin, an alkyd resin, a phenol resin, a vinyl chloride resin, a polysulfone resin, a polyether resin, a polybutadiene resin, a polystyrene resin, a polyacrylonitrile resin, a silica powder, a charge controlling agent, a surface active agent, a lubricant, and the like.

The amount of the above blending material is preferably not more than 50% by weight of the copolymer.

For preventing the occurrence of dehydrochlorination of the copolymer, a stabilizer usually used for the stabilization of vinyl chloride, vinylidene chloride, etc., can be used. Examples of the stabilizer are a metal soap, an epoxy compound, a phosphorous acid ester, a polyol, etc.

Also, as one embodiment of the carrier of the present invention, a multilayer structure can be employed as the coated resin layer of the carrier, and a layer of the resin containing the vinylidene chloride series copolymer described above and layer(s) of other resin(s) can be formed on the carrier core material.

Coating for the carrier core is formed by an ordinary method. For example, the copolymer for use in this invention or a mixture containing the copolymer and a blending material is dissolved or dispersed in an organic solvent to prepare a coating liquid having a solid content of from 0.1 to 30% by weight, and preferably from 1 to 5% by weight, and the coating liquid is coated on the core material by a dip method, a dry spray method, a fluid spray method using a flow coater, etc., followed by drying. If necessary, after forming coating, the coated core material may be heat-treated at a temperature of not higher than 100° C.

As the organic solvent, any solvents which can dissolve the copolymer can be used. Examples of the organic solvent are ketone series solvents such as acetone, methyl ethyl ketone, methyl propyl ketone, methyl isopropyl ketone, methyl isobutyl ketone, cyclohexanone, etc.; acetic acid ester series solvents such as ethyl acetate, cellosolve acetate, n-butyl acetate, etc.; cyclic ethers such as tetrahydrofuran, dioxane, etc.; aromatic hydrocarbons such as toluene, xylene, etc.; halogenated hydrocarbons such as tetrachloroethylene, trichloroethylene, methylene chloride, etc.

These organic solvents may be used singly or as a mixture thereof.

Also, the boiling point of these solvents may be from about 50° to 150° C., but it is preferably from about 60° to 120° C. from the viewpoints of the dissolution treatment and the drying treatment after coating.

There is no particular restriction on the core material of the carrier for use in this invention, and known core materials can be used. Practical examples of the core material are ferrite, magnetite, and retromagnetic metals such as iron, cobalt, nickel, etc.; alloys or compounds containing these metals; alloys which do not contain a ferromagnetic metal but show a ferromagnetic property by a heat treatment, e.g., so-called Heusler's alloys such as Mn-Cu-Al, Mn-Cu-Sn, etc.; and metal oxides such as $CrO_2$, etc.

The particle size of the carrier core is usually from about 20 to 500 μm, and preferably from about 30 to 200 μm.

The thickness of the coating layer of the carrier is preferably from about 0.05 to 5 μm, and more preferably from about 0.3 to 3 μm in dry state. If the thickness is less than 0.05 μm, the durability is insufficient and the charging stability is deteriorated. If the thickness of the coating layer is over 5 μm, there is no substantial problem in the performance but at the thickness, the performance of the carrier reaches almost the highest value and hence the coated layer thicker than 5 μm is uneconomical since a large amount of the copolymer is consumed.

In the carrier of the present invention, the resin to coat the core material may contain conductive fine particles in a dispersed state. As the conductive fine particles, there are a carbon black powder, a graphite powder, and fine particles of inorganic materials such as Ti, Sn, Zn, Cu, Al, Sb, Fe, Ca, Mg, Si, etc., alone, the alloys, oxides, and salts of them.

The conductive fine particles may be used singly or as a mixture thereof. The content of the conductive fine particles is from 0.05 to 20% by weight, and preferably from 0.1 to 10% by weight to the coating resin. The particle size of the conductive fine particles is not larger than 2.0 μm, and preferably not larger than 0.5 μm. When the conductive fine particles form aggregates, the foregoing particle size means the particle size of the primary fine particles, i.e., the fine particles before aggregation.

The carrier of the present invention is used as an electrostatic latent image by combining with a known toner, particularly preferably a positively chargeable toner.

Such a toner is obtained by dispersing a colorant in a binder resin. Examples of the binder resin are homopolymers each composed of a monomer such as styrenes such as styrene, para-chlorostyrene, α-methylstyrene, etc.; s-methylene fatty acid mono-carboxylic acid esters such as methyl acrylate, ethyl acrylate, n-propyl acrylate, butyl acrylate, lauryl acrylate, 2-ethylhexyl acrylate, methyl methacrylate, ethyl methacrylate, n-butyl methacrylate, lauryl methacrylate, 2-ethylhexyl methacrylate, etc.; vinylnitriles such as acrylonitrile, methacrylonitrile, etc.; vinylpyridines such as 2-vinylpyridine, 4-vinylpyridine, etc.; vinyl ethers such as vinyl methyl ether, vinyl isobutyl ether, etc.; vinyl ketones such as vinyl methyl ketone, vinyl ethyl ketone, methyl isopropenyl ketone, etc.; unsaturated hydrocarbons such as ethylene propylene, isoprene, butadiene, etc., and the halogenides thereof; halogen series unsaturated hydrocarbons such as chloroprene, etc., and copolymers composed of two or more foregoing monomers, as well as a mixture of these homopolymers or copolymers.

Furthermore, non-vinylic resins such as a rosin denatured phenol-formalin resin, an oil-denatured epoxy resin, a polyester resin, a polyurethane resin, a polyimide resin, a cellulose resin, a polyether resin, etc., and mixtures of these non-vinylic resins and the foregoing vinylic resins can be used as the binder resin.

Of these resins, a styrenic resin, a polyester resin and an epoxy resin are preferred and a styrene (meth)acrylic acid ester copolymer is particularly preferred.

As the colorant being used for the toner, any pigments and dyes can be used and practical examples are carbon black, Nigrosine, Aniline Blue, Calco Oil Blue, chrome yellow, ultramarine blue, methylene blue, Rose Bengale, phthalocyanine blue, etc.

The colorant is used in an amount of from 0.5 to 20 parts by weight, and preferably from 2 to 10 parts by weight per 100 parts by weight of the binder resin.

As carbon black for the toner in this invention, acidic carbon black is preferred and acidic carbon black having pH of from 2 to 5 is particularly preferred.

While a positively chargeable toner containing acidic carbon black usually shows a low charged amount and delayed raising of charge, combination of the toner with the carrier of the present invention eliminates these demerits, and the resulting developer exhibits a long life capable of keeping a high image quality even after repeated copying for a long time and at various environmental circumstances.

Practical examples of commercially available acidic carbon black are MA7, MA8, MAll, MA100, #1000, #2200B, #2350 and #2400B (trade names, made by Mitsubishi Kasei Co. Ltd.; MOGUL L, REGAL 400R, MONARCH 1000, etc., (trade names, made by Cabot Corporation); and RAVEN series 1035, 1040, 1255, 3500, etc., (trade names, made by Columbia Carbon Japan Limited).

The carbon black preferably has a specific surface area by a BET method of from 25 to 400 $m^2/g$ and a dibutyl phthalate (DBP) oil absorption of from 40 to 40 ml/100 g is preferred, and the carbon black having a specific surface area of from 80 to 150 $m^2/g$ and a dibutyl phthalate (DBP) oil absorption of from 50 to 120 ml/100 g is particularly preferred. Also, if necessary, a small amount of acidic carbon black treated with a metal salt of a carboxylic acid having a melting point of from 70° to 250° C. may be added thereto.

To the toners for use in this invention can be added, if necessary, a charge controlling agent, a mold release agent, etc., in wide ranges.

Known charge controlling agent can be used, such as Nigrosine dyes, triphenylmethane series dyes, amino group-containing vinyl copolymers, quaternary ammonium salt compounds, polyamine resins, etc. The amount of the charge controlling agent is preferably from 0.1 to 25 parts by weight, and more preferably from 1 to 15 parts by weight per 100 parts by weight of the binder resin. In this case, the charge controlling agent may be added into the resin or may be attached to the surface of toner particles.

A particularly preferred charge controlling agent is a quaternary ammonium salt. A quaternary ammonium salt is almost colorless and thus can be used for a black toner and colored toners. In particular, a developer using the toner containing the quaternary ammonium salt is excellent as the developer for an organic photoreceptor forming negative electrostatic latent images.

Quaternary ammonium salt preferably used are those represented by following formula (I) but the quaternary ammonium salt being used in this invention is not limited thereto.

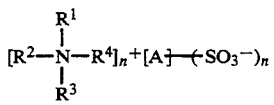

(I)

wherein $R^1$, $R^2$, $R^3$, and $R^4$ each represents a substituted or unsubstituted alkyl group or a substituted or unsubstituted aralkyl group; A represents an aromatic group which may have a substituent; and n represents an integer.

The amount of the quaternary ammonium salt is preferably from 0.1 to 5 parts by weight, and more preferably from 0.3 to 3 parts by weight per 100 parts by weight of the binder resin.

Also, for improving the thermal characteristics of the toners for use in this invention, various waxes may be added thereto as .a releasing agent. As the releasing agent, known ones can be used and examples thereof are a low molecular weight polypropylene resin and polyethylene resin. The amount thereof is preferably from 0.1 to 10 parts by weight, and more preferably from 1 to 5 parts by weight per 100 parts by weight of the binder resin.

Moreover, by coating the surfaces of the toner particles with the fine powder of $TiO_2$, $Al_2O_3$, $SiO_2$, etc., the fluidity and anti-aggregation property of the toner particles can be improved.

The developer of this invention is prepared by mixing the aforesaid carrier and toner. The proper mixing ratio depends upon the particle size and the form of the carrier and the particle size of the toner but the ratio of the carrier to the toner is preferably in the range of from about 99/1 to 9/1. For mixing them, various kinds of mixers or shakers such as a V-blender, a ball mill type mixer, a recipro-shaker, etc. can be used.

An electrostatic latent image holding member used for the electrophotographic developing process of this invention is comprised of an electrically conductive base plate and a photoconductive layer formed thereon.

As the electrically conductive base plate, there are metals such as aluminum, iron, copper, brass, zinc, nickel, stainless steel, etc., a plastic film or a glass sheet rendered electroconductive by vapor-depositing a metal thereon, an electric conductive polymer, etc. Of these, aluminum has been widely used since it is relatively inexpensive, is light weight, and has a good workability. There is no particular restriction on the form of the electrically conductive base plate if the plate has an electric conductivity but a drum form is desirable.

If necessary or desired, a barrier layer is formed on the base plate for preventing the injection of a charge from the base plate into the photoconductive layer. As the barrier layer, for example, an inorganic layer such as anodically oxidized aluminum coating, an aluminum oxide layer, an aluminum hydroxide layer, etc., and a layer of an organic material such as polyvinyl alcohol, casein, polyvinylpyrrolidone, polyacrylic acid, celluloses, gelatin, starch, polyurethane, polyimide, polyamides, etc., are used.

Various organic photoconductive layers can be formed on the base plate but a lamination type photoconductive layer composed of a charge generating layer and a charge transport layer is particularly preferred.

As a photoconductor being used for the charge generating layer, inorganic photoconductors such as selenium and alloys thereof, an arsenic-selenium alloy, cadmiun sulfide, zinc oxide, etc., and various organic pigments such as phthalocyanine, azo pigments, quinacridones, polycyclic quinones, perylene, indigo, benzimidazole, etc., can be used. In these materials, azo pigments such as a monoazo pigment, a bisazo pigment, a trisazo pigment, a polyazo pigment, etc.; non-metal phthalocyanines; and phthalocyanines coordinated with a etal such as copper, indium, gallium, tin, titanium, zinc, vanadium, etc. or with the oxide or chlorides thereof are preferred.

The charge generating layer comprises fine particles of the foregoing photoconductor dispersed in .a binder. In the case of using the organic pigment, the charge generating layer may be a uniform layer of the organic pigment.

As the binder resin being used for the charge generating layer, there are polyvinyl butyral, a phenoxy resin, an epoxy resin, a polyester resin, an acrylic resin, a methacrylic resin, polyvinyl acetate, polyvinyl chloride, methyl cellulose, a polycarbonate resin, etc.

The content of the aforesaid photoconductor in the charge generating layer is preferably from 20 to 300 parts by weight, and particularly preferably from 30 to 150 parts by weight per 100 parts by weight of the binder resin.

The thickness of the charge generating layer is usually not thicker than 5 μm, preferably from 0.01 to 1 μm, and more preferably from 0.15 to 0.6 μm.

Various charge transport materials can be used for the foregoing charge transport layer. For example, there are heterocyclic derivatives such as hydrazone derivatives, pyrazoline derivatives, carbazole, indole, oxadlazole, etc.; arylamine derivatives such as triphenylamine, etc.; stilbene derivatives; and high molecular weight compounds having the foregoing compound at the side chain or the main chain thereof. Of these materials, hydrazone derivatives, arylamines, and stilbene derivatives are preferably used. If necessary, a binder resin is compounded with the charge transport material.

Examples of the preferred binder resin are vinyl polymers or copolymers such as polymethyl methacrylate, polystyrene, polyvinyl chloride, etc.; polyarylate resins, urethane, urea, melamine, polycarbonate, polyester, polysulfone, phenoxy resins, epoxy resins, silicone resins, etc. Partially crosslinked cured products thereof

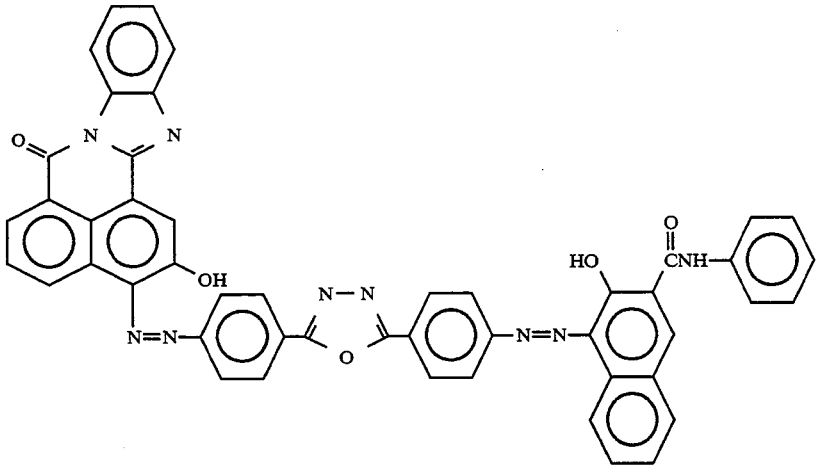

can be also used.

It is preferable that the foregoing charge transport material is compounded with the binder resin in an amount of from 30 to 200 parts by weight, and particularly from 50 to 150 parts by weight per 100 parts by weight of the binder resin.

The charge transport layer may, if necessary or desired, contains various additives such as an antioxidant, a sensitizer, etc.

The thickness of the charge transport layer of usually from 10 to 40 μm, and preferably from 10 to 25 μm.

In addition, as another example of the photoconductive layer, there is a dispersion type photoconductive layer having the fine particles of the foregoing photoconductor dispersed in a mixture of the binder resin and the foregoing charge transport material. In this case, the total content of the photoconductor and the charge transport material is preferably from 20 to 200 parts by weight, and particularly preferably from 40 to 150 parts by weight per 100 parts by weight of the binder resin.

Since the coating layer of the carrier composed of the copolymer of this invention is excellent in film strength and has a good adhesion with the core material, the carrier has an excellent durability, showing a high raising speed of charging and a high chargeability.

Thus, since the carrier of this invention is excellent in charging stability, clear images having a high image density and little fog are obtained using the carrier and the transfer efficiency of toner particles can be increased. While an electrostatic latent image holding member using an organic photoconductor has a low surface hardness, an image defect due to the abrasion with a magnetic brush is minimized with the use of the carrier of this invention and in particular, half tone images having good image quality can be obtained.

The present invention is further explained with reference to the following examples which are intended to illustrate the present invention but not to limit the invention in any way. In the examples, all parts are by weight unless otherwise indicated.

EXAMPLE 1

To 150 parts of 4-methoxy-4-methylpentanone-2 was added 10 parts of a bisazo compound having the structure shown below and the mixture was subjected to a grinding and dispersing treatment by means of a sand grind mill.

The pigment dispersion obtained was added to a 1,2-dimethoxyethane solution containing 5% of polyvinyl butyral (#6000-C, trade name, made by Denki Kagaku Kogyo K.K.) to provide a dispersion having a final solid content of 4.0%.

An aluminum cylinder having an outside diameter of 80 mm, a length of 348 mm, and a thickness of 1.0 mm, the surface of which was subjected to mirror plane finishing, was coated with the dispersion thus obtained by a dip coating method to form a charge generating layer having a dry thickness of 0.4 g/m$^2$.

Then, the aluminum cylinder was dip coated with a solution obtained by dissolving 95 parts of a hydrazone compound having the following structure,

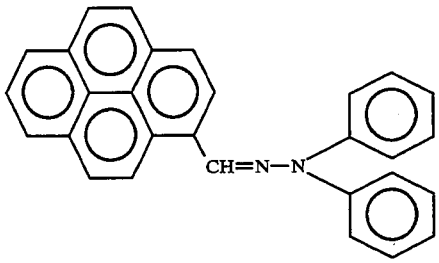

2.5 parts of a cyano compound having the following structure

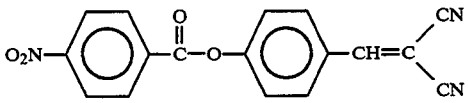

and 100 parts of a polycarbonate resin having the following structure and viscosity average molecular weight of about 30,000

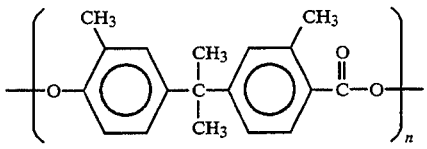

in a mixed solvent of dioxane and tetrahydrofuran, and dried for 30 minutes at room temperature and then for 30 minutes at 125° C. to form a charge transport layer having a dry thickness of 21 μm, whereby a laminate type organic latent image holding member was prepared.

A copolymer composed of 54 mol % of vinylidene chloride and 46 mol % of acrylonitrile was produced, and then the number average molecular weight and the weight average molecular weight (calculated as polystyrene) of the copolymer were measured using a gel permeation chromatography, HLC-8020 (trade name, manufactured by Tosoh Corporation), equipped with two columns, PL10 μmMix (diameter 0.75 cm, length 30 cm) (trade name, manufactured by Polymer Laboratories Co. in England) and using tetrahydrofuran as a solvent. It was found that the number average molecular weight was $6.5\times10^4$ and the weight average molecular weight was $32.8\times10^4$ (hereinafter, the molecular weights were also measured in the same manner).

The copolymer was dissolved in a 1/1 (by volume ratio) mixed solvent of tetrahydrofuran and methyl ethyl ketone to provide a coating liquid having a solid content of 1.8%, with which spherical ferrite particles having a mean particle size of 100 μm (DFC-150, trade name, made by Doowa Teppun K.K.) as a carrier core material were coated by a fluid spray method at a dry thickness of 2 μm to provide a resin-coated carrier.

On the other hand, a toner having a mean particle size of 10 μm was prepared by kneeding and grinding a mixture of 100 parts of a copolymer of styrene and n-butyl acrylate, 5 parts of carbon black, 2 parts of low-molecular weight polypropylene, and 2 parts of a quaternary ammonium salt series charge controlling agent (P-51, trade name, made by Orient Kagaku K.K.). To 100 parts of the toner was added 0.1 part of a hydrophobic silica fine powder (R-972, trade name, made by Degussa AG) and the mixture was mixed with a Henschel mixer to provide a silica-adhered toner.

Then, a developer was prepared by mixing 4 parts of the silica-adhered toner and 100 parts of the foregoing resin-coated carrier.

Using a commercially available copying apparatus (SF8800, trade name, manufactured by Sharp Corporation) mounted with the organic latent image holding member prepared as described above, a practical copying durability test was carried out by a magnetic brush developing method, and images formed was evaluated with respect to the image density, the formation of fog, and the toner transferring ratio.

As a result, clear images having little fog were stably obtained and the toner transferring ratio was good. Even after copying 10,000 copies, almost no stripe-like image defect in half tone images was observed.

Furthermore, when the storage stability (40° C, 48 hours) of the developer was measured by placing 50 g of the developer in a glass bottle, the storage stability of the developer was good.

Furthermore, the same evaluations were carried out in each of the following examples and comparison examples and the results obtained are summarized in Table 1 below.

EXAMPLE 2

In a 1/1 (by volume ratio) mixed solvent of tetrahydrofuran/methyl ethyl ketone was dissolved a binary copolymer (number average molecular weight $7.0\times10^4$, weight average molecular weight $34.1\times10^4$) composed of 50 mol % of vinylidene chloride and 50 mol % of acrylonitrile. Using the copolymer solution obtained, a resin-coated carrier having a dry coating thickness of 0.7 μm was prepared by the same procedure as in Example 1. Thereafter, the same evaluations as in Example 1 were carried out using the resin-coated carrier.

EXAMPLE 3

In a 1/1 (by volume ratio) of tetrahydrofuran/methyl ethyl ketone was dissolved a binary copolymer (number average molecular weight $8.1\times10^4$, weight average molecular weight $38.9\times10^4$) composed of 45 mol % of vinylidene chloride and 55 mol % of acrylonitrile. Using the copolymer solution, a resin-coated carrier having a dry coating thickness of 0.6 μm was prepared by the same procedure as in Example 1. Thereafter, the same evaluations as in Example 1 were carried out using the resin-coated carrier.

EXAMPLE 4

In a 65/35 (by volume ratio) mixed solvent of methyl ethyl ketone/toluene was dissolved a binary copolymer (number average molecular weight $3.9\times10^4$, weight average molecular weight $18.8\times10^4$) composed of 50% of vinylidene chloride and 50 mol % of acrylonitrile. Using the copolymer solution, a resin-coated carrier having a dry coating thickness of 0.5 μm was prepared by the same procedure as in Example 1. Thereafter, the-same evaluations as in Example 1 were carried out using the resin-coated carrier.

EXAMPLE 5

In a 65/35 (by volume ratio) mixed solvent of methyl ethyl ketone/toluene was dissolved a binary copolymer (number average molecular weight $5.3\times10^4$ weight average molecular weight $24.7\times10^4$) composed of 60 mol % of vinylidene chloride and 40 mol % methacrylonitrile. Using the copolymer solution, a resin-coated carrier having a dry coating thickness of 0.7 μm was prepared by the same procedure as in Example 1. Thereafter, the same evaluations as in Example 1 using the resin-coated carrier were carried out.

EXAMPLE 6

In a 65/35 (by volume ratio) mixed solvent of methyl ethyl ketone/toluene was dissolved a copolymer (number average molecular weight $4.8\times10^4$, weight average molecular weight $23.5\times10^4$) composed of 50 mol % of vinylidene chloride and a mixture of 25 mol % of acrylonitrile and 25 mol % of methacrylonitrile as an acrylonitrile derivative. Using the copolymer solution, a resin-coated carrier having a dry coating thickness of 0.5 μm was prepared by the same procedure as in Example 1. Thereafter, the same evaluations as in Example 1 were carried out using the resin-coated carrier.

EXAMPLE 7

By following the same procedure as in Example 1 using a copolymer (number average molecular weight $4.6\times10^4$, weight average molecular weight $38.2\times10^4$) composed of 55 mol % of vinylidene chloride, 20 mol % of acrylonitrile, and 25 mol % of methyl methacrylate, a resin-coated carrier having a dry coating thickness of 0.3 μm was prepared. Thereafter, the same evaluations as in Example 1 were carried out using the resin-coated carrier.

EXAMPLE 8

By following the same procedure as in Example 1 using a copolymer (number average molecular weight $4.1\times10^4$, weight average molecular weight $28.7\times10^4$) composed of 60 mol % of vinylidene chloride, 25 mol % of methacrylonitrile, and 15 mol % of n-butyl acrylate, a resin-coated carrier having a dry coating thickness of 2 μm was prepared. Thereafter, the same evaluations as in Example 1 were carried out using the resin-coated carrier.

EXAMPLE 9

In a 1/1 (by volume ratio) mixed solution of tetrahydrofuran and toluene was dissolved a copolymer (number average molecular weight $4.5\times10^4$ weight average molecular weight $38.3\times10^4$) composed of 46 mol % of vinylidene chloride, 28 mol % of acrylonitrile, and 26 mol % of methyl methacrylate. Using the copolymer solution, a resin-coated carrier having a dry coating thickness of 1 μm was prepared by the same procedure as in Example 1. Thereafter, the same evaluations as in Example 1 were carried out using the resin-coated carrier.

EXAMPLE 10

By following the same procedure as in Example 1 using a copolymer ( number average molecular weight $3.7\times10^4$, weight average molecular weight $26.5\times10^4$) composed of 46 mol % of vinylidene chloride, 24 mol % of acrylonitrile, 29 mol % of methyl methacrylate and 1 mol % of acrylic acid, a resin-coated carrier having a dry coating thickness of 1 μm was prepared. Thereafter, the same evaluations as in Example 1 were carried out using the resin-coated carrier.

EXAMPLE 11

In a 1/1 (by volume ratio) mixed solvent of tetrahydrofuran/methyl ethyl ketone was dissolved a ternary copolymer ( number average molecular weight $4.7\times10^4$, weight average molecular weight $35.4\times10^4$) of 33 mol % of vinylidene chloride, 34 mol % of acrylonitrile, and 33 mol % of methyl acrylate. Using the copolymer solution, a resin-coated carrier having a dry coating thickness of 0.7 μm was prepared by the same procedure as in Example 1. Thereafter, the same evaluations as in Example 1 were carried out using the resin-coated carrier.

EXAMPLE 12

In a 1/1 (by volume ratio) mixed solvent of tetrahydrofuran/methyl ethyl ketone was dissolved a ternary copolymer (number average molecular weight $4.3\times10^4$, weight average molecular weight $32.6\times10^4$) composed of 35 mol % of vinylidene chloride, 36 mol % of methacrylonitrile, and 29 mol % of propyl acrylate. Using the copolymer solution, a resin-coated carrier having a dry coating thickness of 0.8 μm was prepared by the same procedure as in Example 1. Thereafter, the same evaluations as in Example 1 were carried out using the resin-coated carrier.

EXAMPLE 13

In a 65/35 (by volume ratio) mixed solvent of methyl ethyl ketone/toluene was dissolved a ternary copolymer (number average molecular weight $4.2\times10^4$, weight average molecular weight $30.9\times10^4$) composed of 45 mol % of vinylidene chloride, 30 mol % of methacrylonitrile, and 25 mol % of octylacrylate. Using the copolymer solution, a resin-coated carrier having a dry coating thickness of 0.5 μm was prepared by the same procedure as in Example 1. Thereafter, the same evaluations as in Example 1 were carried out using the resin-coated carrier.

EXAMPLE 14

In a 65/35 (by volume ratio) mixed solvent of methyl ethyl ketone/toluene was dissolved a ternary copolymer (number average molecular weight $3.4\times10^4$, weight average molecular weight $25.8\times10^4$) composed of 40 mol % of vinylidene chloride, 35 mol % of methacrylonitrile, and 25 mol % of butyl methacrylate. Using the copolymer solution, a resin-coated carrier having a dry coating thickness of 0.5 μm was prepared by the same procedure as in Example 1. Thereafter, the same evaluations as in Example 1 were carried out using the resin-coated carrier.

EXAMPLE 15

In a 2/1 (by volume ratio) mixed solution of dimethyl formamide/tetrahydrofuran was dissolved a mixture of 1 part of the copolymer as used in Example 1 and 1 part of a polyacrylonitrile resin (number average molecular weight $2.3\times10^4$, weight average molecular weight $8.62\times10^4$). Using the solution thus obtained, a resin-coated carrier having a dry coating thickness of 2 μm was prepared by the same procedure as in Example 1. Thereafter, the same evaluations as in Example 1 were carried out.

EXAMPLE 16

By following the same procedure as in Example 1 using a copolymer (number average molecular weight $3.4\times10^4$, weight average molecular weight $16.6\times10^4$) composed of 77 mol % of vifiylidene chloride and 23 mol % of acrylonitrile. Using the copolymer solution, a resin-coated carrier having a dry coating thickness of 2 μm was prepared by the same procedure as in Example 1. When the same evaluations as in Example 1 were carried out using the resin-coated carrier, clear images having little fog were stably obtained. Also, the toner transferring ratio was good. After copying 10,000 copies, almost no stripe-like image defect in half tone images was observed. However, the storage stability of the developer was inferior.

EXAMPLE 17

In a 1/1 (by volume ratio) mixed solvent of tetrahydrofuran/methyl ethyl ketone was dissolved a binary copolymer (number average molecular weight $5.1\times10^4$, weight average molecular weight $25.6\times10^5$) composed of 30 mol % of vinylidene chloride and 70 mol % of acrylonitrile. By following the same procedure as in Example 1 using the solution obtained above, a resin-coated carrier having a dry coating thickness of 1.0 μm was prepared. When the the same evaluations as in Example 1 were carried out using the resin-coated carrier, initially, clear images having little fog were obtained. Also, the toner transferring ratio and the storage stability of the developer were good. However, after copying 10,000 copies, the practical copying durability was slightly deteriorated.

EXAMPLE 18

In a 1/1 (by volume ratio) mixed solvent of tetrahydrofuran/methyl ethyl ketone was dissolved a binary component (numerical average weight $6.6\times10^4$, weight average molecular weight $30.3\times10^4$) composed of 25 mol % of vinylidene chloride and 75 mol % of acrylonitrile. Using the copolymer solution, a resin-coated carrier having a dry coating thickness of 0.5 μm was prepared by the same procedure as in Example 1. When the same evaluations as in Example 1 were carried out using the resin-coated carrier, initially, clear images having little fog were obtained. Also, the toner transferring ratio and the storage stability of the developer were good. Furthermore, after copying 10,000 copies, almost no stripe-like image defect in half tone images was observed However, the practical copying durability after copying 10,000 copies was inferior.

EXAMPLE 19

| | |
|---|---|
| Styrene-n-Butyl Acrylate Copolymer Resin (monomer ratio = 82/18 by mol ratio) | 100 parts |
| Acidic Carbon Black (MA 8, pH = 3.0, trade name, made by Mitsubishi Chemical Industries Ltd.) | 5 parts |
| Charge Controlling Agent (Quaternary Ammonium Salt, Bontron P-5, trade name, made by Orient Kagaku K.K.) | 2 parts |
| Polypropylene Wax (550P, trade name, made by Sanyo Chemical Industries, Ltd.) | 2 parts |

The foregoing components were melt-kneaded at 150° C. using a hot role mill, after cooling the cooled kneaded mixture was coarsely ground using a hammer mill, and finely ground using a grinder by an air jet system. By classifying the fine powder obtained, the fine particles having particle sizes of from 5 μm to 20 μm were selected to provide toner particles having a mean particle size of 10 μm.

The toner particles were mixed with 0.3% by weight of a silica fine powder (R972, trade name, made by Nippon Aerosil K.K.) with a Henschel mixer to provide a black toner.

Separately, a ferrite powder having a mean particle size of 100 μm was coated with a copolymer resin composed of 54 mol % of vinylidene chloride and 46 mol % of acrylonitrile by a fluid spray method using a flow coater in an amount of 0.5% by weight based on the ferrite powder, the coated ferrite powder was dried to provide a resin-coated carrier.

Then, a positively chargeable developer was prepared by mixing 4 parts of the foregoing toner and 96 parts of the carrier using a V-blender.

By using the developer, a continuous copying test of 100,000 copies was carried out using a dry-type copying apparatus with a commercially available organic photoconductor as the photoreceptor under a normal temperature-normal humidity conditions (25° C, 60% RH).

As the result, the charged amount was not changed, and copies of high image quality having little fog (stains at the background portions of copies), having high density and uniformity at the black portions of the copies, and having an excellent gradation were obtained.

Separately, the continuous practical copying test of 100,000 copies was carried out by the same manner as above under a high-temperature high-humidity condition (30° C, 85 to 90% RH) and a low-temperature low-humidity condition (10° C, 20 to 25% RH). In both cases, the charged amount was not changed and was almost the same as that under the aforesaid normal-temperature normal-humidity condition, and copies of high image quality having no problems in fog, density, and gradation were obtained.

COMPARISON EXAMPLE 1

A developer was prepared using as a carrier spherical ferrite particles without being coated with a resin and the silica-adhered toner as used in Example 1, and the same evaluations were carried out as in Example 1 using the developer. As a result, the image density was lowered with repeating copying. Furthermore, fog became remarkable from the beginning and only stained images were obtained. Also, the transferring ratio of the toner was inferior and a large amount of the untransferred toner was recovered. Moreover, after practically copying 10,000 copies, a stripe-like defect in half tone images was observed.

COMPARISON EXAMPLE 2

By following the same procedure as Comparison Example 1, except for using a commercially available silicon resin-coated carrier (core material was ferrite), a developer was prepared. When the same evaluations as Comparison Example 1 were carried out, the image density was almost good but images formed slightly had fog and slightly stained. Also, the recovered amount of the untransferred toner was not small, showing somewhat inferior transferring ratio. After practically copying 10,000 copies, a stripe-like defect in half tone images was observed.

COMPARISON EXAMPLE 3

By following the same procedure as in Comparison Example 1, except for using a commercially available vinylidene fluoride resin-coated carrier (core material was ferrite), a developer was prepared. When the same evaluations as in Comparison Example 1 were carried out using the developer, the formation of fog was relatively low and the toner transferring ratio was relatively good but the image density was low. Also, the storage stability of the developer was inferior.

TABLE 1

| | Properties of Carrier Resin | | | | | | Evaluation | | | | | |
|---|---|---|---|---|---|---|---|---|---|---|---|---|
| | Resin Composition (monomer mol %) | | | Molecular Weight | | | Initial Image Evaluation | | Durable Practically Copied Images (10,000 copies) | | | Storage Stability (Developer) |
| | VDC | AN | Others | (× $10^4$) | (× $10^4$) | (°C.) | Density | Fog | Denisty | Fog | Toner transferring Ratio | 40° C. × 48 hrs |
| Example 1 | 54 | 46 | 0 | 6.5 | 32.8 | 46 | 1.40 ◎ | ◎ | ◎ | ◎ | 92 | ○ |
| Example 2 | 50 | 50 | 0 | 7.0 | 34.1 | 54 | 1.41 ◎ | ◎ | ○ | ◎ | 92 | ◎ |
| Example 3 | 45 | 55 | 0 | 8.1 | 38.9 | 59 | 1.41 ◎ | ◎ | Δ~○ | ○ | 91 | ◎ |
| Example 4 | 50 | 50 | 0 | 3.9 | 18.8 | 54 | 1.41 ◎ | ◎ | ○ | ○ | 90 | ◎ |
| Example 5 | 60 | 40 | 0 | 5.3 | 24.7 | 43 | 1.40 ◎ | ◎ | ◎ | ◎ | 91 | ○ |
| Example 6 | 50 | AN/MAN = 25/25 | 0 | 4.8 | 23.5 | | 1.41 ◎ | ◎ | ○ | ◎ | 90 | ◎ |
| Example 7 | 55 | 20 | MMA 25 | 4.6 | 38.2 | | 1.42 ◎ | ◎ | ○ | Δ~○ | 91 | ○ |
| Example 8 | 60 | 25 | nBA 15 | 4.1 | 28.7 | | 1.40 ◎ | ◎ | ○ | ○ | 91 | ○ |
| Example 9 | 46 | 28 | MMA 26 | 4.5 | 38.3 | 68 | 1.40 ◎ | ◎ | ○ | ○ | 89 | ◎ |
| Example 10 | 46 | 24 | MMA/ acrylic acid = 29/1 | 3.7 | 26.5 | 70 | 1.40 ◎ | ◎ | ○ | ○ | 90 | ○ |
| Example 11 | 33 | 34 | MMA 33 | 4.7 | 35.4 | | 1.43 ◎ | ○ | ○ | Δ~○ | 90 | ◎ |
| Example 12 | 35 | 36 | MMA 29 | 4.3 | 32.6 | | 1.43 ◎ | ○ | ○ | Δ~○ | 89 | ◎ |
| Example 13 | 45 | 30 | MMA 25 | 4.2 | 30.9 | | 1.40 ◎ | ◎ | ○ | ○ | 91 | ◎ |
| Example 14 | 40 | 35 | MMA 25 | 3.4 | 25.8 | | 1.42 ◎ | ◎ | ○ | ○ | 90 | ◎ |
| Example 15 | A mixture of a part of resin in Example 1 and a part of P-AN (Mw 8.6 × $10^4$) (Mn 2.3 × $10^4$) | | | | | | 1.42 ◎ | ◎ | ◎ | ○ | 90 | ○ |
| Example 16 | 77 | 23 | 0 | 3.4 | 16.6 | 18 | 1.39 ○ | ◎ | ○ | ◎ | 91 | X |
| Example 17 | 30 | 70 | 0 | 5.1 | 25.6 | 73 | 1.42 ◎ | ○ | Δ | Δ | 90 | ◎ |
| Example 18 | 25 | 75 | 0 | 6.6 | 30.3 | 77 | 1.43 ◎ | ○ | Δ | Δ~X | 89 | ◎ |
| Comparison Example 1 | Uncoated ferrite | | | | | | 1.33 Δ | X | X | X | 62 | ◎ |
| Comparison Example 2 | Silicon resin | | | | | | 1.38 ○ | Δ | Δ~○ | Δ~X | 81 | ◎ |
| Comparison Example 3 | Vinylidene fluoride resin | | | | | | 1.26 Δ | ○ | Δ | Δ | 89 | X |

VDC: Vinylidene Chloride
AN: Acrylonitrile
MAN: Methacrylonitrile
MMA: Methyl Methacrylate
nBA: n-Butyl Acrylate
P-AN: Polyacrylonitrile Resin
Evaluation of Storage Stability of Developer
◎: No change
○: Aggregates observed a little
Δ: Aggregates exist but are fluid
X: Solidified
Evaluation for the others◎: Excellent
○: Fairly good
Δ: good
X: bad While the invention has been described in detail and with reference to specific embodiments thereof, it will be apparent to one skilled in the art that various changes and modifications can be made therein without departing from the spirit and scope thereof.

What is claimed is:

1. A developer for an electrostatic latent image comprising a carrier and a positively chargeable toner, wherein said carrier comprises a core material at least a part of which is coated with a resin containing a copolymer comprised of vinylidene chloride and at least one monomer having an unsaturated double bond and being copolymerizable with vinylidene chloride, and wherein said toner contains a quaternary ammonium salt as a charge controlling agent.

2. The developer as in claim 1, wherein said copolymer is comprised of (a) from 60 to 30 mol % of vinylidene chloride, (b) from 20 to 50 mol % of acrylonitrile and/or an acrylonitrile derivative, and (c) from 0 to 30 mol % of a monomer having an unsaturated double bond. and being copolymerizable with components (a) and (b).

3. The developer as in claim 1, wherein said copolymer is a binary copolymer comprising (a) from 60 to 40 mol % of vinylidene chloride and (b) from 40 to 60 mol % of acrylonitrile and/or an acrylonitrile derivative.

4. The developer as in claim 1, wherein said copolymer has a glass transition temperature of from 20° C. to 90° C.

5. The developer as in claim 1, wherein (b) acrylonitrile and/or an acrylonitrile derivative of said copolymer is acrylonitrile, methacrylonitrile, or a mixture of acrylonitrile and methacrylonitrile.

6. The developer as in claim 1, wherein (c) a monomer having an unsaturated double bond and being copolymerizable with components (a) and (b) of said copolymer is at least one monomer selected from the group consisting of styrenes, α-substituted or unsubstituted alkyl (meth)acrylates, vinyl ethers, vinyl esters, vinyl ketones, olefins, and nitrogen-containing compounds.

7. The developer as in claim 1, wherein said copolymer has a weight average molecular weight of from $6\times10^4$ to $60\times10^4$ when measured by gel permeation chromatography.

8. The developer as in claim 1, wherein said copolymer has a weight average molecular weight of from $20\times10^4$ to $40\times10^4$ when measured by gel permeation chromatography.

9. The developer as in claim 1, wherein the resin for coating the carrier is a blend resin obtained by mixing (i) the copolymer of vinylidene chloride and at least one monomer having an unsaturated double bond and being copolymerizable with said vinylidene chloride and (ii) other resin in an amount of not more than 50% by weight of said copolymer.

10. The developer as in claim 1, wherein the thickness of the coating layer of said carrier is from 0.05 μm to 5 μm.

11. The developer as in claim 1, wherein the resin for coating the carrier contains an electrically conductive fine powder having a mean particle size of not larger than 2 μm.

12. The developer as in claim 1, wherein said copolymer contained in the resin for coating the carrier is a copolymer comprised of (a) vinylidene chloride and (b) acrylonitrile and/or an acrylonitrile derivative, or a copolymer comprised of (a) vinylidene chloride, acrylonitrile and/or an acrylonitrile derivative, and (c) a monomer having an unsaturated double bond and being copolymerizable with components (a) and (b).

13. The developer as in claim 1, wherein said copolymer contained in the resin coating the carrier is comprised of (a) from 70 to 30 mol % of vinylidene chloride, (b) from 20 to 60 mol % of acrylonitrile and/or an acrylonitrile derivative, and (c) from 0 to 40 mol % of a monomer having an unsaturated double bond and being copolymerizable with components (a) and (b).

14. The developer as in claim 1, wherein said positively chargeable toner contains acidic carbon black as a colorant.

15. The developer as in claim 1, wherein said positively chargeable toner contains a styrene-(meth)-acrylic acid ester copolymer as a binder resin.

16. The developer as in claim 1, wherein said positively chargeable toner contains a releasing agent.

17. The developer as in claim 1, wherein the quaternary ammonium salt is a compound represented by the following formula (I)

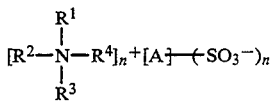

$$[R^2-\overset{\overset{R^1}{|}}{\underset{\underset{R^3}{|}}{N}}-R^4]_n{}^+[A]-(SO_3{}^-)_n \quad (I)$$

wherein $R^1$, $R^2$, $R^3$, and $R^4$ each represents a substituted or unsubstituted alkyl group or a substituted or unsubstituted aralkyl group; A represents a substituted or unsubstuited aromatic group; and n represents an integer.

18. The developer as in claim 17, wherein the amount of the quaternary ammonium alt is from 0.1 to 5 parts by weight per 100 parts by weight of a binder resin contained in the toner.

19. The developer as claimed in claim 1, wherein the core material is selected from the group consisting of ferrite, magnetite, $CrO_2$, Mn-Cu-Al, Mn-Cu-Sn, ferromagnetic metals, alloys of ferromagnetic metals, and compounds containing ferromagnetic metals.

20. An electrophotographic developing process which comprises forming an electrostatic latent image on an electrophotographic photoreceptor using an organic photoconductor, and developing the latent image with a develope containing a carrier and a toner by a magnetic brush developing method, wherein said carrier comprises a core material at least a part of which is coated with a resin containing a copolymer comprised of vinylidene chloride and at least one monomer having an unsaturated double bond and being copolymerizable with vinylidene chloride, and wherein said toner contains a quaternary ammonium salt as a charge controlling agent.

21. The electrophotographic developing process as in claim 20, wherein said copolymer contained in the resin for coating the carrier is a copolymer comprised of (a) vinylidene chloride and (b) acrylonitrile and/or an acrylonitrile derivative, or a copolymer comprised of (a) vinylidene chloride, (b) acrylonitrile and/or an acrylonitrile derivative, and (c) at least one monomer having an unsaturated double bond and being copolymerizable with components (a) and (b) .

22. The electrophotographic developing process as in claim 20, wherein said copolymer contained in the resin for coating the carrier is comprised of (a) from 70 to 30 tool % of vinylidene chloride, (b) from 20 to 60 mol % of acrylonitrile and/or an acrylonitrile derivative, and (c) from 0 to 40 mol % of a monomer having an unsaturated double bond and being copolymerizable with components (a) and (b).

23. The electrophotographic developing process as in claim 20, wherein said toner contains acidic carbon black as a colorant.

24. The electrophotographic developing process as in claim 20, wherein said toner contains a styrene(meth)acrylic acid ester copolymer resin as a binder resin.

25. The electrophotographic developing process as in claim 20, wherein said organic photoconductor is a laminate type organic photoconductor comprising a base plate having formed thereon a charge generating layer and a charge transport layer.

26. The electrophotographic developing process as in claim 20, wherein the quaternary ammonium salt is a compound represented by the following formula (I)

$$[R^2-\overset{\overset{R^1}{|}}{\underset{\underset{R^3}{|}}{N}}-R^4]_n{}^+[A]-(SO_3{}^-)_n \quad (I)$$

wherein $R^1$, $R^2$, $R^3$, and $R^4$ each represents a substituted or unsubstituted alkyl group or a substituted or unsubstituted aralkyl group; A represents a substituted or unsubstituted aromatic group; and n represents an integer.

27. The electrophotographic developing process as in claim 26, wherein the amount of the quarternary ammonium salt is from 0.1 to 5 parts by weight per 100 parts by weight of a binder resin contained in the toner.

* * * * *